United States Patent [19]

Imazeki et al.

[11] Patent Number: 4,633,264

[45] Date of Patent: Dec. 30, 1986

[54] HORN ANTENNA

[75] Inventors: Kazuyoshi Imazeki; Seiji Kayama, both of Tokyo, Japan

[73] Assignee: General Research of Electronics, Inc., Tokyo, Japan

[21] Appl. No.: 580,522

[22] Filed: Feb. 15, 1984

[30] Foreign Application Priority Data

Feb. 17, 1983 [JP] Japan ..... 58-025965

[51] Int. Cl.[4] ..... H01Q 13/02

[52] U.S. Cl. ..... 343/786; 343/756

[58] Field of Search ..... 343/786, 756, 783, 772, 343/776, 785, 778

[56] References Cited

U.S. PATENT DOCUMENTS

| | | | |
|---|---|---|---|
| 3,482,251 | 12/1969 | Bowes | 343/786 |
| 3,541,560 | 11/1970 | Lyon et al. | 343/756 |
| 3,569,974 | 3/1971 | McLeod | 343/756 |
| 4,219,820 | 8/1980 | Crail | 343/756 |

FOREIGN PATENT DOCUMENTS

| | | | |
|---|---|---|---|
| 601280 | 5/1948 | United Kingdom | 343/786 |

OTHER PUBLICATIONS

Ewell, Polarization-Transforming Antenna Feed Horns, IEEE Trans. Ant. & Prop., vol. AP-19, No. 5, Sep. 1971, pp. 681-682.

*Primary Examiner*—Eli Lieberman
*Assistant Examiner*—Michael C. Wimer
*Attorney, Agent, or Firm*—Trexler, Bushnell & Wolters, Ltd.

[57] ABSTRACT

A horn antenna comprises a horn of the type including a rectangular throat, a rectangular opening located in a plane parallel to and spaced part from the throat and having at least one dimension larger than a corresponding dimension of the throat, and four wall portions joining the throat and the opening. An electrically conductive member is disposed so as to define any one diagonal across the horn from and including the opening to and including the throat.

10 Claims, 5 Drawing Figures

HORN ANTENNA

BACKGROUND OF THE INVENTION

This invention relates generally to the antenna arts and more particularly to a novel and improved horn-type antenna.

Generally speaking, a horn antenna may be defined as an expanded opening of desired size formed in a cross section of a wave guide. More particularly, a horn antenna comprises a rectilinear flared horn-like structure coupled to a cross sectional opening in a rectangular wave guide, at least one side thereof diverging or flared out to define an enlarged rectangular opening. The area about which the expanded or diverging horn meets the wave guide is generally referred to as a throat.

The two dimensions or surfaces of a rectangular wave guide are generally referred to as H and E surfaces with reference to the lines of magnetic (H) and electric (E) force associated with wave guide theory. A horn antenna may be formed by the expansion or divergence of either or both of these H and E surfaces of a rectangular wave guide. In this regard, a so-called "fan shaped horn antenna" is one in which the expansion or divergence is of only one of these H and E surfaces.

While the invention may find other utility, the ensuing description will be facilitated with specific reference to horn antennas for transmitting and receiving in the X and K bands of electromagnetic radiation. In this regard, the X band comprises waves in the frequency range of between 10.500 GHz and 10.550 GHz, while the K band comprises electromagnetic waves in the frequency range between 24.050 GHz and 24.250 GHz.

In accordance with the invention, a surprising improvement is realized in the receiving sensitivity of such a horn antenna. Moreover, the sensitivity differences known to exist between the horizontal and vertical polarization of the electromagnetic radiation can be substantially eliminated by the invention. Accordingly, improved reception for X and K band signals can be obtained at any angular position at which the antenna may be mounted with respect to an incoming signal, without experiencing such polarization differences.

OBJECTS AND SUMMARY OF THE INVENTION

It is a general object of this invention to provide a novel and improved horn antenna.

A more specific object is to provide a horn antenna capable of marked improvement in receiving sensitivity over conventional horn antennas.

A related object is to provide a horn antenna capable of substantially eliminating sensitivity difference between horizontal and vertical polarization of the electromagnetic wave.

Briefly and in accordance with the foregoing objects, a horn antenna in accordance with the invention comprises a horn of the type including a rectangular throat, a rectangular opening located in a plane parallel to and spaced apart from said throat portion and having at least one dimension larger than a corresponding dimension of said throat, four wall portions joining said throat and said opening; and an electrically conductive member disposed so as to define any one diagonal across said horn from and including said opening to and including said throat.

BRIEF DESCRIPTION OF THE DRAWINGS

The features of the present invention which are believed to be novel are set forth with particularity in the appended claims. The organization and manner of operation of the invention, together with further objects and advantages thereof, may best be understood by reference to the following description taken in connection with the accompanying drawings in the several figures of which like reference numerals identify like elements, and in which:

DETAILED DESCRIPTION OF THE ILLUSTRATED EMBODIMENT

Figure 1:
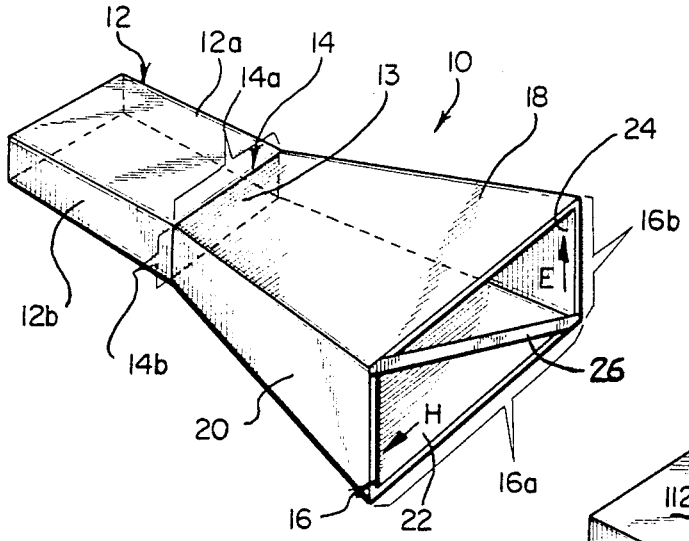
FIG. 1 is a perspective view of a horn antenna in accordance with a preferred embodiment of the invention.

Referring to the drawings and initially to FIG. 1, a horn antenna in accordance with a preferred embodiment of the invention is designated generally by the reference numeral 10. The antenna 10 extends from a cross-sectional end opening 13 of a rectangular wave guide 12. In this regard, the antenna 10 includes a rectangular throat portion 14 which is of like dimensions to the cross-section of wave guide 12 and is joined with the open end 13 thereof. In accordance with conventional practice, the horn antenna 12 also includes a rectangular opening 16 in a plane parallel to and spaced from the plane of the throat 14 and joined thereto by four substantially flat wall portions or surfaces 18, 20, 22 and 24. In accordance with conventional terminology, one pair of parallel wall surfaces **12*a* of the rectangular wave guide 12 may be referred to as the H surfaces while the other pair of surfaces 12*b*** may be referred to as the E surfaces. This is in accordance with the designation of orthogonal components of an electromagnetic wave, that is, the H or magnetic lines of force and the E or electric lines of force.

In the embodiment of FIG. 1, both the H surfaces and E surfaces are effectively expanded by the horn 10. Hence, walls 18 and 22 may be referred to as H surfaces, and walls 20 and 24 as E surfaces. All of walls 18, 20, 22 and 24 generally diverge or expand from the throat 14 to the opening 16. The rectangular opening 16 therefore defines two dimensions **16*a* and 16*b*, both of which are greater than corresponding dimensions 14*a* and 14*b* of the rectangular throat 14**.

Figure 4:
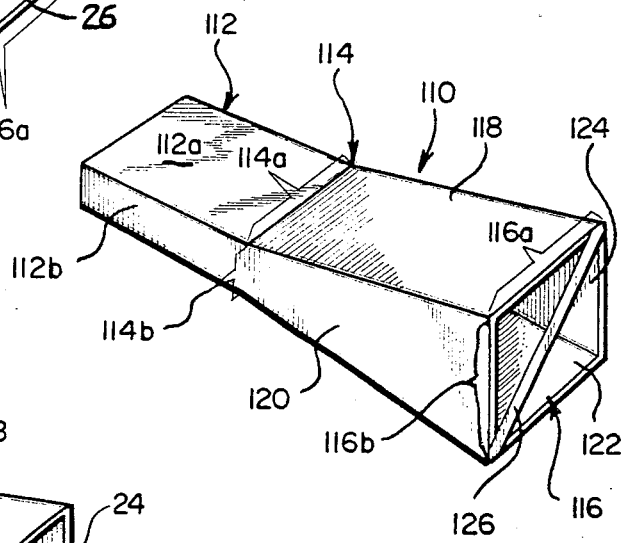
FIG. 4 is a perspective view similar to FIG. 1 of a horn antenna in accordance with another embodiment of the invention.
Figure 5:
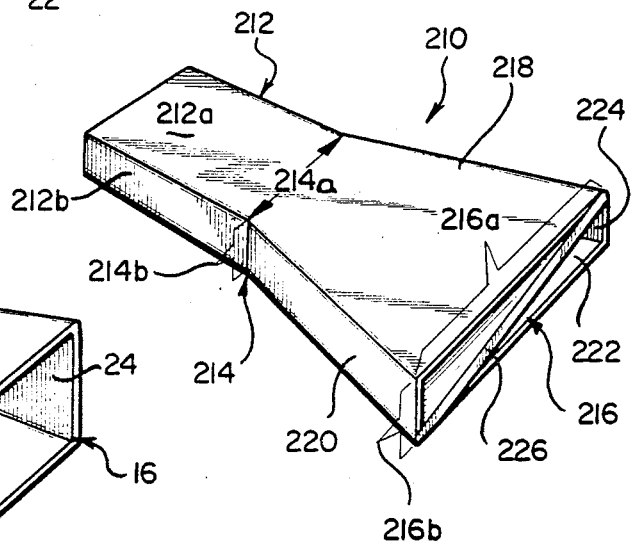
FIG. 5 is a perspective view similar to FIGS. 1 and 4 of a horn antenna in accordance with yet a further embodiment of the invention.

Referring briefly to FIGS. 4 and 5, the invention also includes a so-called fan-type horn antenna wherein only one of the H or E surfaces of the wave guide are expanded. Hence, only one of the dimensions **116*a*, 216*a* and 116*b*, 216*b* of the openings 116, 216 is greater than the corresponding dimension 114*a*, 214*a* or 114*b*, 214*b* of the throat 114, 214**.

Referring now to the remaining drawings, and departing from convention, a strip of electrically conductive material 26 is disposed across a diagonal of the horn 10. In this regard, the material 18 may be a metallic material such as a copper or aluminum strip or plate or may be made of a metal wire or rod material. In accordance with the invention, this electrically conductive member 26 may extend across any one diagonal through the horn 10 between the throat 14 and opening 16. Moreover, the diagonal strip 26 may extend across such a diagonal, at any inclination and position, from and including the plane of the opening 16 to and including the plane of the throat 14.

Figure 2:
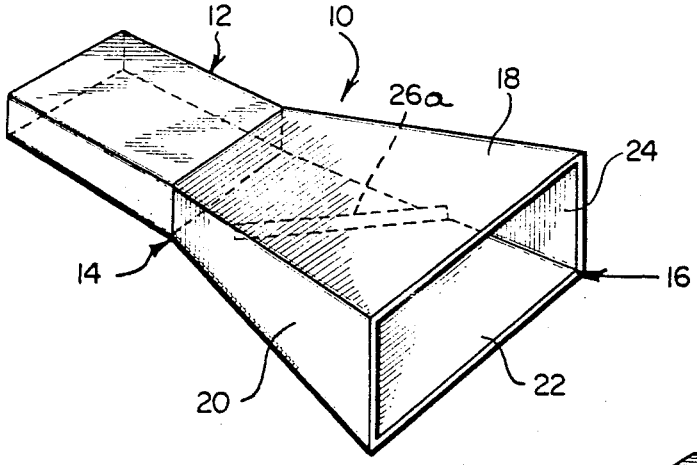
FIG. 2 is a perspective view of a horn antenna similar to FIG. 1 and illustrating a modification within the scope of the invention.
Figure 3:
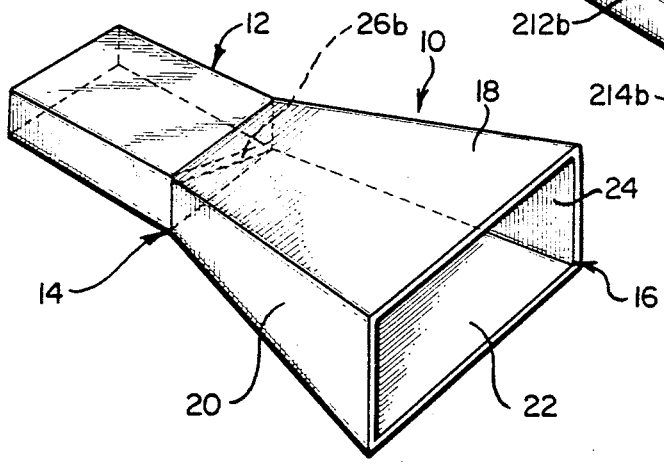
FIG. 3 is an enlarged view of a portion of the horn antenna of FIG. 1 and illustrating a further modification within the scope of the invention.

Accordingly, FIG. 1 illustrates the diagonal conductive member 26 extending diagonally across the opening 16, while FIG. 2 illustrates a similar conductive member 26*a* inclined with respect to the planes of the throat 14 and opening 16 and extending across an interior portion of horn 10. Finally, FIG. 3 illustrates a further similar conductive member 26*b* extending diagonally across the throat portion 14.

In FIGS. 4 and 5, similar diagonally disposed electrically conductive members 126, 226 are provided in the same fashion as described above with reference to FIG. 1 with respect to the openings 116, 216 of respective fan-type antennas 110 and 210. However, it will be understood that only one such diagonal member is utilized in accordance with the invention.

For purposes of fully describing at least one embodiment, dimensions of the horn antenna 12 and wave guide 10 of FIG. 1 for purposes of X-band reception and transmission are generally as follows. The dimension 14*a* of the throat 14 is 22.9 mm, the dimension 14*b* is 10.2 mm. Both dimensions 16*a* and 16*b* of the horn antenna opening 16 are 29 mm. The width or thickness of the diagonal member 26 is 10 mm. In this regard, the so-called X-band includes radar or microwave signals in the frequency range from 10.500 GHz to 10.550 GHz.

In the foregoing example, it has been found that the horn antenna 10 as shown in FIG. 1 can receive X-band signals at a distance of on the order of 1.5 kilometers without the diagonal member 26. However, with the provision of diagonal member 26 this distance is substantially doubled. Accordingly, a surprising improvement in receiving sensitivity of the antenna is achieved by provision of the diagonal member 26. Moreover, it has been found that the sensitivity difference between the horizontal and vertical polarization of the electromagnetic waves is substantially eliminated by provision of the diagonal member 26. Hence, reception for X-band signals, for example, can be greatly improved at any angular position without any noticeable polarization differences.

While particular embodiments of the invention have been shown and described in detail, it will be obvious to those skilled in the art that changes and modifications of the present invention, in its various aspects, may be made without departing from the invention in its broader aspects, some of which changes and modifications being matters of routine engineering or design, and others being apparent only after study. As such, the scope of the invention should not be limited by the particular embodiment and specific construction described herein but should be defined by the appended claims and equivalents thereof. Accordingly, the aim in the appended claims is to cover all such changes and modifications as fall within the true spirit and scope of the invention.

The invention is claimed as follows:

1. A horn antenna comprising: a horn of the type including a rectangular throat, a rectangular opening located in a plane parallel to and spaced apart from said throat and having at least one dimension larger than a corresponding dimension of said rectangular throat, four wall portions joining said rectangular throat and said rectangular opening; said walls meeting each other to define respective corners of said horn along lines joining respective corners of said throat and said opening; and a relatively thin, straight, elongate electrically conductive member disposed so as to extend completely across any one diagonal across said horn from any point along one corner thereof to any point along a diagonally opposite corner thereof, from and including said rectangular opening to and including said rectangular throat.

2. A horn antenna in accordance with claim 1 wherein said rectangular opening is greater in both dimensions thereof than the dimensions of said rectangular throat, whereby each of said four wall portions diverges in the direction from said throat to said opening.

3. A horn antenna according to claim 2 wherein said electrically conductive member comprises a relatively thin, substantially straight strip of metallic material.

4. A horn antenna according to claim 1 wherein said conductive member is disposed diagonally across and in the plane of said opening.

5. A horn antenna according to claim 2 wherein said conductive member is disposed diagonally across and in the plane of said opening.

6. A horn antenna according to claim 1 wherein said conductive member is disposed in the plane of said rectangular throat.

7. An improvement in a horn antenna of the type including a rectangular throat and a rectangular opening respectively disposed in parallel, spaced planes, at least one dimension of said rectangular opening being greater than a corresponding dimension of said rectangular throat, and four sidewalls respectively joining corresponding sides of said rectangular opening and said rectangular throat, said walls meeting each other to define respective corners of said horn along lines joining respective corners of said throat and said opening, said improvement comprising: a relatively thin, straight, elongate electrically conductive member disposed so as to extend completely across any one diagonal across said horn from any point along one corner thereof to any point along a diagonally opposite corner thereof, from and including said rectangular opening to and including said rectangular throat.

8. The improvement according to claim 7 wherein said electrically conductive member comprises a relatively thin, substantially straight strip of metallic material.

9. The improvement according to claim 7 wherein said conductive member is disposed diagonally across and in the plane of said rectangular opening.

10. The improvement according to claim 7 wherein said conductive member is disposed diagonally across and in the plane of said rectangular throat.

* * * * *